United States Patent [19]

Alexander

[11] 3,950,974

[45] Apr. 20, 1976

[54] LOCK CASE HAVING ADJUSTABLE FRONT

[75] Inventor: Gordon A. Alexander, Newington, Conn.

[73] Assignee: Emhart Corporation, Farmington, Conn.

[22] Filed: May 19, 1975

[21] Appl. No.: 578,997

[52] U.S. Cl. ..... 70/450

[51] Int. Cl.[2] ..... E05B 9/08

[58] Field of Search ..... 70/450, 447, 448, 451, 70/461; 292/337

[56] References Cited

UNITED STATES PATENTS

| | | | |
|---|---|---|---|
| 166,797 | 8/1875 | Mix | 70/450 |
| 332,849 | 12/1885 | Voll | 70/450 |
| 562,515 | 6/1896 | Endres | 70/150 |
| 2,497,189 | 2/1950 | Shaffer | 70/450 |
| 2,996,326 | 8/1961 | Schlage | 292/337 |

*Primary Examiner*—Robert L. Wolfe

*Attorney, Agent, or Firm*—McCormick, Paulding & Huber

[57] ABSTRACT

A mortise lock case having a body including top and bottom walls and an angularly adjustable front attached to the body by upper and lower tabs carried by the front and secured, respectively, to the top and bottom walls by associated fasteners. The top and bottom walls have integral forwardly projecting tongues received in associated slots in the front. Each tongue has fulcrums at its opposite sides engageable with the side walls of the slot in which it is received. Each fulcrum cooperates with an associated slot side wall to provide pivotal support for the front whereby to facilitate angular positioning of the front relative to the body of the case.

9 Claims, 7 Drawing Figures

LOCK CASE HAVING ADJUSTABLE FRONT

BACKGROUND OF THE INVENTION

This invention relates in general to lock or latch case structures and deals more particularly with a case structure of the type which includes a case body and an angularly adjustable front through which one or more bolts project.

A lock or latch which has a case of the aforedescribed type ordinarily has its case body received in a mortise opening or recess in a door and its front mortised or otherwise recessed into the edge of the door, the front being angularly adjustable relative to the body so that it may be mounted flush with the door edge regardless of whether the edge has a right or left hand bevel or is substantially perpendicular to the faces of the door. However, in such a lock structure, a problem is encountered in adjustably securing the front to the body of the case to facilitate a full range of angular adjustment. When the front is secured to the case body by tabs or the like the pivotal axis of the front is ordinarily spaced some distance rearwardly of the front so that each angular adjustment is accompanied by some lateral displacement of the front relative to the body. Sufficient clearance must be provided between the bolt or bolts and the bolt receiving apertures in the front to compensate for such lateral displacement. However, it is further desirable that such clearance be minimal, which may cause binding to occur between the bolt or bolts and the front or the strike plate when the front is angularly adjusted to the requirements of a door on which the lock is installed. The present invention is primarily concerned with this problem.

SUMMARY OF THE INVENTION

In accordance with the invention, an improved case structure is provided which includes a case body having top and bottom walls and an angularly adjustable front assembly including a front carrying upper and lower tabs. One fastener secures the upper tab to the top wall and another fastener secures the lower tab to the bottom wall. At least one of the aforementioned walls has a forwardly projecting tongue which projects into a slot in the front. The tongue provides fulcrums which cooperate with associated walls of the slot to provide pivotal support for the front relative to the case body.

DETAILED DESCRIPTION OF PREFERRED EMBODIMENT

Figure 1:
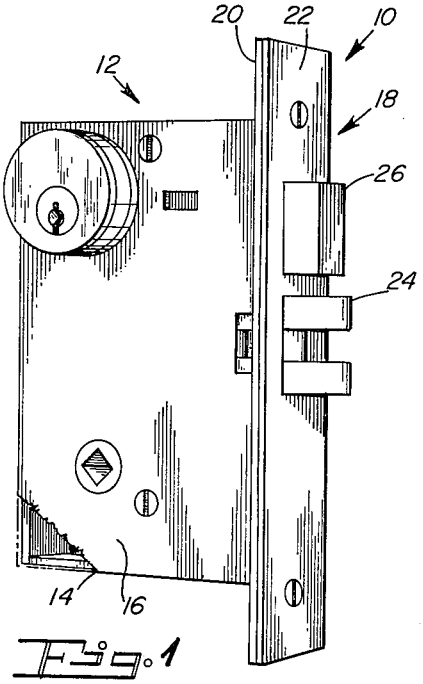
FIG. 1 is a perspective view of a mortise lock having a case embodying the present invention.
Figure 2:
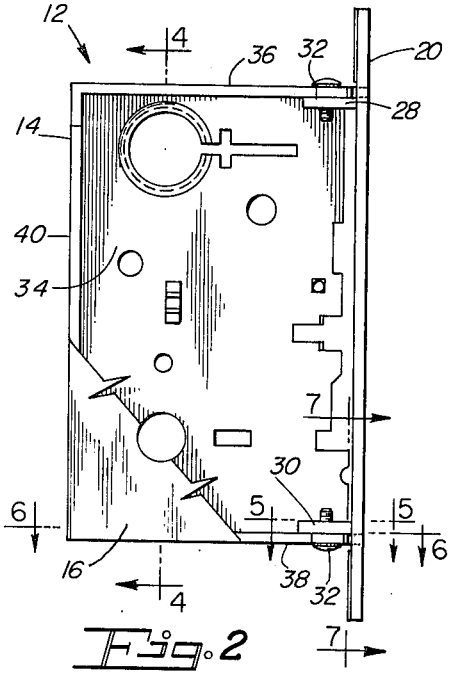
FIG. 2 is a side elevational view of the case of the lock shown in FIG. 1.
Figure 3:
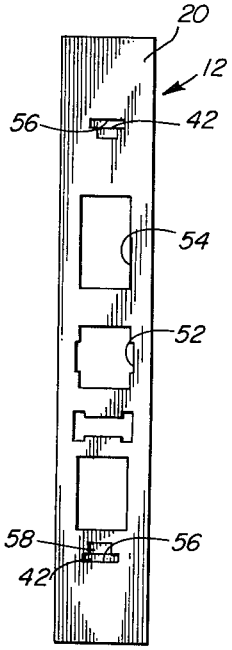
FIG. 3 is a front view of the lock case.
Figure 4:
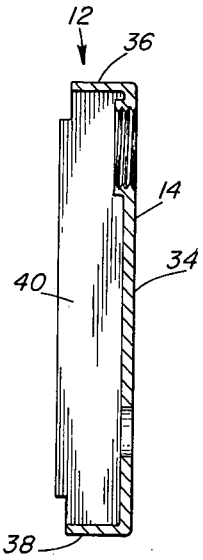
FIG. 4 is a sectional view taken along the line 4—4 of FIG. 2.
Figure 5:
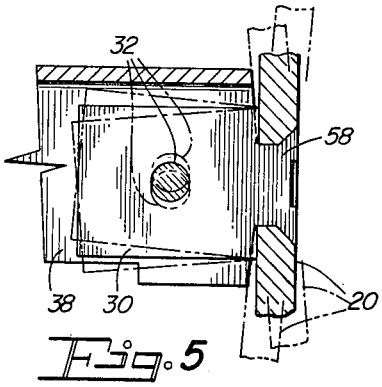
FIG. 5 is a somewhat enlarged sectional view taken along the line 5—5 of FIG. 2.
Figure 6:
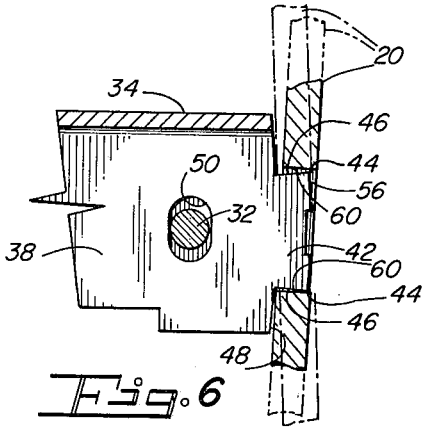
FIG. 6 is a somewhat enlarged sectional view taken along the line 6—6 of FIG. 2.
Figure 7:
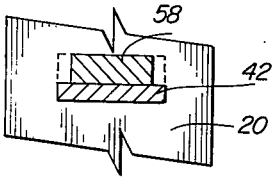
FIG. 7 is a somewhat enlarged sectional view taken along the line 7—7 of FIG. 2.

Referring now to the drawing, a mortise lock 10, illustrated in FIG. 1, has a case embodying the invention and designated generally by the reference numeral

12. The case 12 includes a body 14, which has a cover or cap 16, and a front assembly indicated generally at 18 which is angularly adjustable relative to the body 14 and includes a front 20 and a finish or face plate 22. One or more locking elements, such as the latch bolt 24 and the deadbolt 26, shown in FIG. 1, extend through the front assembly and are controlled by conventional operating mechanisms. However, since the operating mechanisms comprise no part of the invention and are not essential to an understanding of the invention, details of the operating mechanisms have been omitted from the drawings, for purposes of clarity. When the lock 10 is assembled with an associated door (not shown) the case body 14 is received in a mortise opening in the door and the front assembly is received in a complementary formed recess in the edge of the door.

The front assembly 18 further includes upper and lower tabs indicated at 28 and 30, respectively, which are carried by the front 20 and project rearwardly therefrom. The pair of fasteners 32, 32 secure the upper tab 28 and the lower tab 30, respectively, to the top and bottom walls of the body 14, as will be hereinafter further described. In accordance with the invention, at least one of the latter walls has an integral forwardly projecting tongue received in an associated slot in the front 20 and disposed adjacent an associated one of the tabs. The tongue has fulcrums at opposite sides thereof engageable with respectively associated surfaces of the slot in which it is received to facilitate angular adjustment of the front 20 relative to the body 14, as will be hereinafter further discussed.

Considering now the structure of the case 12 in further detail, and referring particularly to FIGS. 2–7, the case body 14 is preferably formed from sheet metal and has a sidewall 34, top and bottom walls indicated at 36 and 38, respectively, and a rear wall 40. Preferably, and as shown, the top and bottom walls 36 and 38 are substantially identical, each being provided with a forwardly projecting tongue. The bottom wall 38, which is typical and best shown in FIG. 6 includes an integral forwardly projecting tongue 42 which has fulcrums 44, 44 at the junctions of its front and side surfaces. The side surfaces of the tongue, indicated at 46, 46 are respectively inclined rearwardly and inwardly or toward each other from the fulcrums 44, 44. Each side surface 46 is normal to an associated portion of the lower wall front surface 48. A slot 50 formed in the bottom wall 38 rearwardly of the tongue 42 extends in a transverse direction relative to the bottom wall and receives an associated fastener 32 therethrough which threadably engages the lower tab 30.

The front 20 comprises a vertically elongated rectangular plate and has apertures 52 and 54 therein to receive the latch bolt 24 and the deadbolt 26, respectively, therethrough. Additional openings are or may be formed in the front 20 to accommodate other mechanism as, for example, an auxiliary latch bolt or a stop works which may be optionally provided. Upper and lower slots 56, 56 are formed in the front 20. Each slot 56 receives the retaining portion of an associated tab. Referring again to the lower wall structure shown in FIGS. 5 and 6, the lower tab 30 is retained in an associated portion of the lower slot 56 by a dove-tailed retaining portion 58 which substantially complements an associated portion of the lower slot 56. The tab 30 is preferably assembled in the slot and staked to the front 20. The remaining or torque receiving portion of the lower slot 56 has a width substantially equal to the width of the lower tongue 42. The tongue receiving portion of the slot 56 is partially defined by opposing inwardly facing side surfaces 60, 60 each of which is respectively engageable with an associated fulcrum 44.

When the lock 10 is installed on a door, mortise openings are first formed in the door to receive the case body 14 and the front assembly 18. The fasteners 32, 32 are loosened whereupon the front 20 is pivoted on fulcrums 44, 44 to a desired position of adjustment after which the fasteners 32, 32 are tightened to retain the front assembly in selected angular position relative to the body. The arrangements of the fulcrums 44, 44 relative to the associated slot side surfaces 60, 60 allow the front 20 to pivot on the body 14 without substantial lateral shifting movement of the front relative to the body. This arrangement permits minimal clearance to be maintained between the bolts 24 and 26 and the associated bolt receiving apertures 52 and 54 in the front 20 and corresponding bolt receiving apertures in the face plate 22.

I claim:

1. In a lock case for supporting a bolt and a bolt operating mechanism and having a body including top and bottom walls, an angularly adjustable front assembly adapted to be secured to an edge of a door and including a front having an opening therein for receiving the bolt therethrough and upper and lower tabs connected to the front and projecting rearwardly therefrom, and a pair of fasteners, one of said fasteners securing said upper tab to said top wall, the other of said fasteners securing said lower tab to said bottom wall, the improvement comprising at least one of said walls having a forwardly projecting tongue including fulcrums at opposite sides thereof, said front having a slot therein partially defined by opposing side surfaces for receiving said tongue therein, each of said fulcrums being engageable with an associated one of said slot side surfaces.

2. The combination as set forth in claim 1 wherein said fulcrums are disposed at the forward end portion of said tongue and said forward end portion has a width substantially equal to the width of an associated portion of said slot.

3. The combination as set forth in claim 1 wherein said tongue has side surfaces rearwardly and inwardly inclined from said fulcrums.

4. The combination as set forth in claim 3 wherein said fulcrums are defined by the junctions of said side surfaces and the front surface of said tongue.

5. The combination as set forth in claim 4 wherein the width of said tongue at the forward end thereof is substantially equal to the width of an associated portion of said slot.

6. The combination as set forth in claim 1 wherein one of said members comprising said tongue and said tab associated with said one wall has a slot therein and said fastener associated therewith extends through said slot and threadably engages the other of said members.

7. The combination as set forth in claim 6 wherein said one member comprises said one wall and said other member comprises said associated tab.

8. The combination as set forth in claim 1 wherein said tongue is disposed adjacent an associated one of said tabs and said associated tab has a retaining portion received and retained in an associated portion of said slot.

9. The combination as set forth in claim 8 wherein said retaining portion comprises a dove-tailed portion substantially complementing said associated portion of said slot.

* * * * *